US008783683B2

(12) United States Patent
Izumiya et al.

(10) Patent No.: US 8,783,683 B2
(45) Date of Patent: Jul. 22, 2014

(54) IMAGE FORMING APPARATUS AND IMAGE FORMING SYSTEM

(75) Inventors: Kenji Izumiya, Tokyo (JP); Hiroshi Oyama, Tokyo (JP); Yumiko Izumiya, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 0 days.

(21) Appl. No.: 13/562,644

(22) Filed: Jul. 31, 2012

(65) Prior Publication Data

US 2013/0032993 A1 Feb. 7, 2013

(30) Foreign Application Priority Data

Aug. 2, 2011 (JP) ..... 2011-169413

(51) Int. Cl.
*B65H 9/16* (2006.01)
*B65H 9/04* (2006.01)
*B65H 7/02* (2006.01)

(52) U.S. Cl.
USPC ..... 271/249; 271/248; 271/227; 271/253; 271/254

(58) Field of Classification Search
USPC ..... 271/248, 249, 227, 228, 253, 254
See application file for complete search history.

(56) References Cited

U.S. PATENT DOCUMENTS 7,195,238 B2 * 3/2007 Suga et al. ..... 271/228
7,880,871 B2 * 2/2011 Kazama et al. ..... 356/139.04
8,540,239 B2 * 9/2013 Kaiga et al. ..... 271/227
2007/0040326 A1 * 2/2007 Noda et al. ..... 271/227
2008/0240820 A1 * 10/2008 deJong et al. ..... 399/395
2009/0317114 A1 * 12/2009 Uchida et al. ..... 399/68
2010/0123284 A1 * 5/2010 Herrmann ..... 271/227
2011/0266742 A1 * 11/2011 Sato et al. ..... 271/228
2012/0112405 A1 * 5/2012 Hirota ..... 271/227
2013/0156478 A1 * 6/2013 Deno ..... 399/395
2013/0214482 A1 * 8/2013 Matsumoto ..... 271/228

FOREIGN PATENT DOCUMENTS

JP 2007-062690 A 3/2007
JP 2007-320759 A 12/2007
JP 2009-256003 A 11/2009
JP 2010-002653 A 1/2010
JP 2011-013405 A 1/2011

OTHER PUBLICATIONS

Japanese Office Action dated Sep. 24, 2013 (and English translation thereof) in counterpart Japanese Application No. 2011-169413.
Japanese Office Action dated Dec. 10, 2013 (and English translation thereof) in counterpart Japanese Application No. 2011-169413.

* cited by examiner

*Primary Examiner* — Patrick Cicchino
(74) *Attorney, Agent, or Firm* — Holtz Holtz Goodman & Chick PC

(57) ABSTRACT

An image forming apparatus acquires sheet information indicating paper weight or the like of a transported sheet of paper. The apparatus also has a control portion and shifts a reference position which has been previously set to a direction orthogonal to a transporting direction of the sheet of paper based on the paper weight or the like of the transported sheet of paper. A deviation sensor detects a deviation of the sheet of paper with regard to the shifted reference position along the direction orthogonal to the transporting direction of the sheet of paper. A sheet shift portion shifts the sheet of paper to the shifted reference position based on the deviation detected by the deviation sensor.

14 Claims, 10 Drawing Sheets

IMAGE FORMING APPARATUS AND IMAGE FORMING SYSTEM

CROSS REFERENCE TO RELATED APPLICATION

The present invention contains subject matter related to Japanese Patent Application JP 2011-169413 filed in the Japanese Patent Office on Aug. 2, 2011, the entire contents of which being incorporated herein by reference.

BACKGROUND OF THE INVENTION

1. Field of the Invention

The present invention relates to an image forming apparatus that forms an image on a sheet of paper and an image forming system including the same.

2. Description of Related Art

An image forming apparatus equipped with multiple functions, which is simultaneously provided with various functions such as a printer, a scanner, a copy machine and a facsimile, has been widely used in recent years. In such an image forming apparatus, it is very important that a position of a sheet of paper transported from any of feeding trays or the like is accurately aligned so that an image can be suitably transferred in an image forming unit. Thus, for example, the image forming apparatus has registration rollers at an upstream side of a secondary transfer portion which transfers the image on the sheet of paper. The registration rollers then correct any oblique movements of the sheet of paper by hitting a forward end of the sheet of paper against the registration rollers or any deviations of the sheet of paper by shifting the sheet of paper to a reference position, so that the image forming apparatus controls a transported position of the sheet of paper with high accuracy.

FIGS. 1A through 1C respectively show a correction of the deviations of the sheet of paper, which has been performed in the past. As shown in FIG. 1A, a deviation detection sensor 300 detects a position through which a transported sheet of paper P passes. A controller, not shown, calculates an amount of deviation ΔLa of the sheet of paper P on a direction D2 which is orthogonal to a transportation direction D1 of the sheet of paper P, as shown in FIG. 1B, based on the position of the sheet of paper P detected by the deviation detection sensor 300 and a reference position SD which has been previously set. A registration and fluctuation unit 360, which has a pair of rollers and is provided at an upstream side of the secondary transfer portion which transfers the image on the sheet of paper, stops the transportation of the sheet of paper P and holds the sheet of paper P between the pair of rollers to shift it back to the reference position SD along the direction D2 by the amount of deviation ΔLa which is calculated by the controller as shown in FIG. 1C. Accordingly, the sheet of paper P is shifted back to the reference position SD, thereby enabling the deviation of the sheet of paper P to be corrected.

When controlling the transported position of the sheets of paper P with high accuracy, however, a lot of the sheets of paper which have the same size are fed passing through the same reference position in a fixing unit provided at a downstream side of the secondary transfer portion. Any scratches may occur on fixing rollers constituting the fixing unit by the edges of sheets of paper P. These scratches cause any stripped strains or blur to occur on the image, so that a poor printing sheet(s) of paper may occur. Thus, life of the fixing unit having the fixing rollers becomes short and an exchange span of the fixing unit also becomes short.

In order to prevent the scratches from occurring on the fixing rollers, a technology in which the sheets of paper are intentionally shifted to change their passed positions has been known. For example, Japanese Patent Application Publication No. 2010-2653 has disclosed an image forming apparatus in which a shift unit drives a pair of registration rollers to shift a reference position of detecting means for a sheet of paper transported to a fixing unit by some distance for every group of a set number of transported sheets of paper so that any abrasion by the edges of the sheets of paper in the fixing rollers is decreased.

However, the past image forming apparatus, which has been disclosed in Japanese Patent Application Publication No. 2010-2653, has a configuration such that when performing in-line processing on sheets of paper ejected from an image forming apparatus in a post-processing device, the image forming apparatus stacks the transported sheets of paper under its alignment function and put one sheet of paper on top of another sheet of paper with high accuracy. Further, in this image forming apparatus, since the sheets of paper are transported to the post-processing device with their reference positions being shifted on the basis of the correction of the deviation of each of the sheets of paper in the image forming apparatus, flexible thin sheets of paper are, particularly, aligned with less accuracy.

FIGS. 2A and 2B show an example of paper alignment processing of the sheets of paper in the past post-processing device. The sheets of paper P which have been shifted by the shift unit of the image forming apparatus are transported into an alignment portion composed of a pair of alignment plates 400, 400 in the post-processing device. The alignment portion aligns the sheets of paper P by moving the alignment plates 400, 400 from their home positions to their alignment positions. In this alignment processing, as shown in FIG. 2B, when the sheet of paper is small sized one or a thick sheet of paper (they are referred to as "sheet of paper P1"), the sheet of paper P1 has large stiffness (is stiff) so that if the pair of alignment plates 400, 400 align the sheets of paper P1, the pair of alignment plates 400, 400 can align the sheet of paper P1 correctly. On the other hand, when the sheet of paper is large sized one or a thin sheet of paper (they are referred to as "sheet of paper P2"), the sheet of paper P2 has small stiffness (is flexible) so that if the pair of alignment plates 400, 400 align the sheets of paper P2, each of the sheets of paper P2 is folded or flexed, which causes its alignment accuracy to be considerably decreased. This leads to a deterioration of final finishing accuracy.

SUMMARY OF THE INVENTION

An object of the present invention is to provide the image forming apparatus or an image forming system in which the above-mentioned problems are solved.

To achieve the above-mentioned object, an image forming apparatus that forms an image on a sheet of paper, reflecting one aspect of the present invention, contains an information acquiring portion which acquires sheet information indicating quality or transporting condition of the transported sheet of paper, a control portion that is configured to shift a reference position which has been previously set to a direction orthogonal to a transporting direction of the sheet of paper based on the sheet information acquired by the information acquiring portion, a detection portion which detects a deviation of the sheet of paper with regard to the reference position shifted by the control portion along the direction orthogonal to the transporting direction of the sheet of paper, and a sheet shift portion which shifts the sheet of paper to the reference position shifted by the control portion based on the deviation detected by the detection portion, the sheet shift portion being positioned at an upstream side of an image forming position on which the image is formed on the sheet of paper.

It is desirable to provide the image forming apparatus wherein the information acquiring portion includes a paper-weight-acquiring part which acquires paper weight as the quality of the transported sheet of paper, and the control portion is configured to shift the reference position to the direction orthogonal to the transporting direction of the sheet of paper based on the paper weight of the sheet of paper acquired by the paper-weight-acquiring part.

It is desirable to provide the image forming apparatus wherein the control portion is configured to stop a shift operation of the reference position when the paper weight of the sheet of paper acquired by the paper-weight-acquiring part is smaller than a previously set reference value thereof, and the control portion is configured to perform the shift operation of the reference position when the paper weight of the sheet of paper acquired by the paper-weight-acquiring part is not smaller than the previously set reference value thereof.

It is desirable to provide the image forming apparatus wherein the control portion is configured to change an amount of shift based on the paper weight of the sheet of paper when shifting the reference position to the direction that is orthogonal to the transporting direction of the sheet of paper.

It is desirable to provide the image forming apparatus wherein the control portion is configured to change an amount of shift periodically when shifting the reference position to the direction that is orthogonal to the transporting direction of the sheet of paper.

It is desirable to provide the image forming apparatus wherein the information acquiring portion includes a sheet-width-acquiring part which acquires a size of a width of the transported sheet of paper along the direction that is orthogonal to the transporting direction of the sheet of paper as the quality of the transported sheet of paper, and the control portion is configured to shift the reference position to the direction that is orthogonal to the transporting direction of the sheet of paper based on the size of the width of the transported sheet of paper acquired by the sheet-width-acquiring part.

It is desirable to provide the image forming apparatus wherein when the size of the width of the transported sheet of paper is smaller than a previously set reference value thereof, the control portion is configured to perform a shift operation of the reference position by setting an amount of shift so as to be larger than the amount of shift set when the size of the width of the transported sheet of paper is not smaller than the previously set reference value thereof, and when the size of the width of the transported sheet of paper is not smaller than the previously set reference value thereof, the control portion is configured to perform the shift operation of the reference position by setting an amount of shift so as to be smaller than the amount of shift set when the size of the width of the transported sheet of paper is smaller than the previously set reference value thereof.

It is desirable to provide the image forming apparatus wherein the information acquiring portion includes a speed-acquiring part which acquires a transporting speed of the sheet of paper as the transporting condition of the transported sheet of paper, when the transporting speed of the sheet of paper acquired by the speed-acquiring part does not exceed a previously set reference speed thereof, the control portion is configured to perform a shift operation of the reference position by setting an amount of shift so as to be larger than the amount of shift set when the transporting speed of the sheet of paper acquired by the speed-acquiring part exceeds the previously set reference value thereof, and when the transporting speed of the sheet of paper acquired by the speed-acquiring part exceeds the previously set reference value thereof, the control portion is configured to perform the shift operation of the reference position by setting an amount of shift so as to be smaller than the amount of shift set when the transporting speed of the sheet of paper acquired by the speed-acquiring part does not exceed the previously set reference value thereof.

It is desirable to provide the image forming apparatus further comprising a duplex printing portion which prints both surfaces of the sheet of paper, wherein the control portion is configured to perform a shift operation of the reference position when printing a front of the sheet of paper, and the control portion is configured to shift the reference position to a previously set default reference position when printing a back of the sheet of paper using the duplex printing portion.

It is desirable to provide the image forming apparatus further comprising an image forming portion which forms the image on the sheet of paper, wherein the control portion is configured to control the image forming portion to shift an image forming position based upon the shifted reference position and to form the image on the sheet of paper.

It is desirable to provide the image forming apparatus further comprising an image forming portion which forms the image on the sheet of paper, and a fixing portion which fixes the image transferred on the sheet of paper by the image forming portion, the fixing portion being provided at a downstream side of the image forming portion along the transporting direction of the sheet of paper.

Further, to achieve the above-mentioned object, an image forming system contains an image apparatus that forms an image on a sheet of paper and a post-processing device including a paper alignment portion which aligns the sheets of paper ejected from the image forming apparatus.

The concluding portion of this specification particularly points out and directly claims the subject matter of the present invention. However, those skilled in the art will best understand both the organization and method of operation of the invention, together with further advantages and objects thereof, by reading the remaining portions of the specification in view of the accompanying drawing(s) wherein like reference characters refer to like elements.

DESCRIPTION OF THE PREFERRED EMBODIMENTS

The following will describe embodiments of an image forming apparatus and an image forming system relating to the inventions with reference to drawings. In the inventions, for example, the sheet information indicating quality of the transported sheet of paper is information on paper weight of the sheet of paper, information on a size of a width of the sheet of paper or the like. The sheet information indicating the transporting condition of the transported sheet of paper is, for example, information on a transporting speed of the sheet of paper, information on which is a surface of the sheet of paper, a front thereof or a back thereof or the like.

First Embodiment

Configuration Example of Image Forming System

Figure 3:
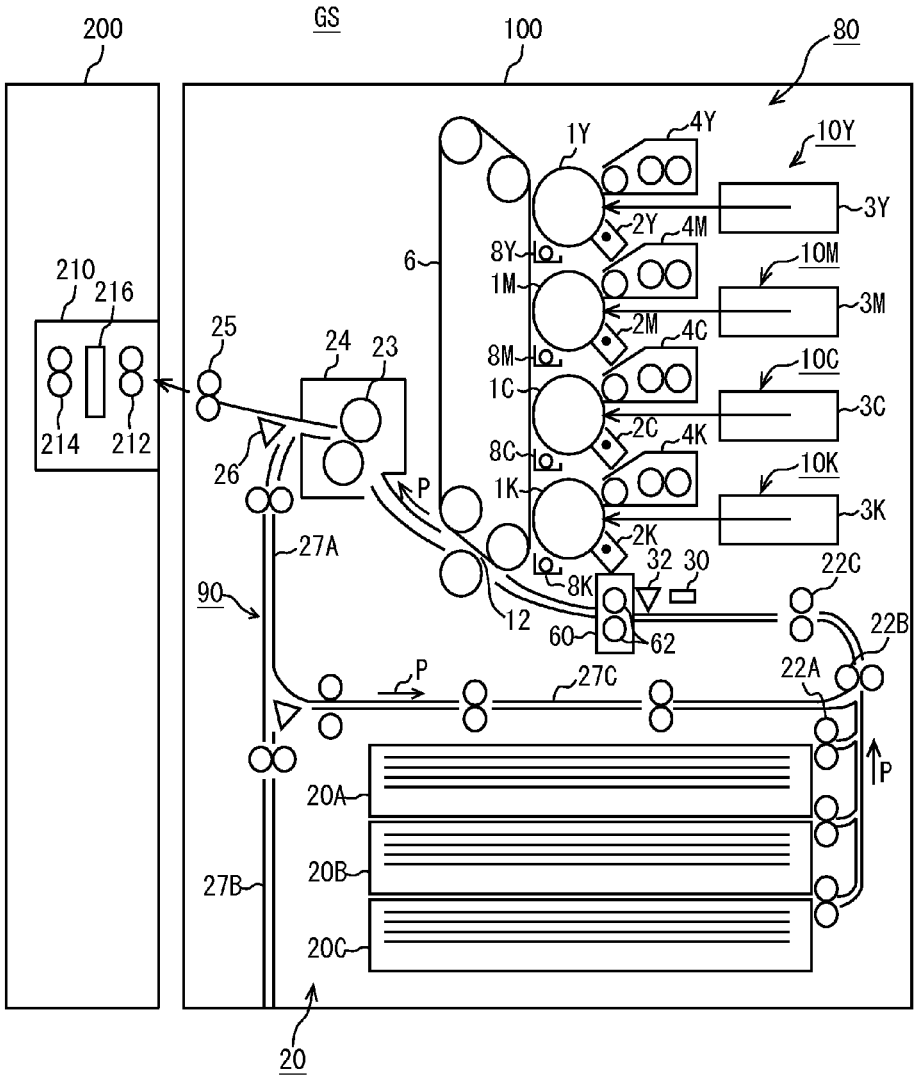
FIG. 3 is a diagram showing an outline configuration of an image forming system according to a first embodiment of the present invention.

FIG. 3 schematically shows an outline configuration example of the image forming apparatus GS according to a first embodiment of this invention. It is to be noted that any detailed configurations of an automatic document feeder and an image reading apparatus such as an image sensor, which are provided above an image forming apparatus 100, will be omitted because they are slightly related to these inventions.

The image forming apparatus GS according to this invention acquires any sheet information on quality of a transported sheet of paper such as paper weight of a transported sheet of paper P and controls an amount of shift by a registration and fluctuation unit 60 based on the acquired sheet information of the sheet of paper P. Thus, the image forming apparatus GS maintains alignment accuracy in alignment processing of the post-processing device 200 and prevents fixing rollers 23 from being scratched by edges of sheets of paper P.

As shown in FIG. 3, the image forming apparatus GS is provided with the image forming apparatus 100 and the post-processing device 200. The image forming apparatus 100 is referred to as "an image forming apparatus of tandem type" and contains an image forming portion 80, a feeder 20, a fixing unit 24, a registration sensor 32 and a deviation detection sensor 30.

The image forming portion 80 forms an image based on electrographic process and contains an image forming unit 10Y which forms an yellow image (Y), an image forming unit 10M which forms a magenta image (M), an image forming unit 10C which forms a cyan image (C) and an image forming unit 10K which forms a black image (K) and an intermediate transfer belt 6. In this embodiment, the common functions are indicated by Y, M, C and K, which respectively show colors to be formed, following a number, for example, 10.

The image forming unit 10Y contains a photosensitive drum 1Y, a charging portion 2Y which is arranged around the photosensitive drum 1Y, an exposing portion (optical writing portion) 3Y, a developing portion 4Y and a cleaning portion 8Y. The image forming unit 10M contains a photosensitive drum 1M, a charging portion 2M which is arranged around the photosensitive drum 1M, an exposing portion 3M, a developing portion 4M and a cleaning portion 8M. The image forming unit 10C contains a photosensitive drum 1C, a charging portion 2C which is arranged around the photosensitive drum 1C, an exposing portion 3C, a developing portion 4C and a cleaning portion 8C. The image forming unit 10K contains a photosensitive drum 1K, a charging portion 2K which is arranged around the photosensitive drum 1K, an exposing portion 3K, a developing portion 4K and a cleaning portion 8K.

The respective photosensitive drums (image supporting members) 1Y, 1M, 1C and 1K, the charging portions 2Y, 2M, 2C and 2K, the exposing portion 3Y, 3M, 3C and 3K, the developing portions 4Y, 4M, 4C and 4K and the cleaning portions 8Y, 8M, 8C and 8K in the image forming unit 10Y, 10M, 10C and 10K have the common configuration. They will be described with Y, M, C and K being omitted except for any cases in which they are required to be distinguished.

The charging portion 2 charges a static charge uniformly around a surface of the photosensitive drum 1. The exposing portion 3 is composed of, for example, a laser scanning exposure device of polygon mirror type. The exposing portion 3 scans a surface of the photosensitive drum 1 using laser beam based on the image information signal to form a latent image. The developing portion 4 develops the latent image formed on the surface of the photosensitive drum 1 by using toner. This enables a toner image, which is a visual image, to be formed on the photosensitive drum 1.

The intermediate transfer belt 6 extends between the rollers in a tension state and is supported to be able to run. When primary transfer rollers are moved, the intermediate transfer belt 6 runs so that toner images formed on the respective photosensitive drums 1 are transferred to their predetermined image transfer locations of the intermediate transfer belt 6 (primary transfer).

The feeder 20 is provided with plural feeding trays 20A, 20B and 20C. The feeding trays 20A, 20B and 20C respectively contain sheets of paper such as A3 or A4 sized ones. The feeder 20 transports the sheet of paper P from any of the feeding trays 20A, 20B and 20C to the registration and fluctuation unit 60 by using the conveying rollers 22A, 22B and 22C and the like.

The registration sensor 32 is positioned at an upstream side of the registration and fluctuation unit 60 along the transporting direction of the sheet of paper P and detects a forward end of the sheet of paper P transported from the feeder 20. The deviation detection sensor 30 detects any deviations of the transported sheet of paper in relation to a reference position of the sheet of paper P. The deviation detection sensor 30 is positioned at an upstream side of the registration sensor 32 along the transporting direction of the sheet of paper and detects a position of a side end of the sheet of paper P transported from the feeder 20. The deviation detection sensor 30 constitutes a detection portion.

The registration and fluctuation unit 60 contain a pair of rollers 62, 62 and is positioned at an upstream side of secondary transfer portion (image forming position) 12 in which the image is formed on the sheet of paper P. The registration and fluctuation unit 60 nips the sheet of paper P based on a detection result of the registration sensor 32 and shifts the sheet of paper P to a direction D2 that is orthogonal to a transporting direction D1 of the sheet of paper P to correct the deviation of the sheet of paper P. The registration and fluctuation unit 60 hits a forward end of the sheet of paper P against the rollers 62, 62 so that the sheet of paper P is looped to perform a positional deflection correction of the sheet of paper P. It is to be noted that the registration and fluctuation unit 60 constitutes the sheet shift portion.

The sheet of paper P, a deviation or the like of which has been corrected by the registration and fluctuation unit 60, is transported at a fixed timing to the secondary transfer portion 12 in which the image is transferred. In the secondary transfer portion 12, color images formed on the image forming positions of the intermediate transfer belt 6 are transferred all together to the sheet of paper P transported from the feeder 20 (secondary transfer). The sheet of paper P in which the secondary transfer is carried out is transported to the fixing unit 24.

The fixing unit 24 is positioned at a downstream side of the secondary transfer portion 12 and contains a pair of fixing rollers 23, 23. The fixing unit 24 performs heating and pressing on the sheet of paper P on which the color image is transferred to fix the color image on the sheet of paper P. The sheet of paper P fixed by the fixing unit 24 is ejected by paper ejection rollers 25 to the post-processing device 200.

The image forming apparatus 100 is provided with a sheet inverting portion 90 which inverts the sheet of paper P from the front thereof to the back thereof or vice reverse at a downstream side of the fixing unit 24 along the transporting direction of the sheet of paper P. The sheet inverting portion 90 constitutes a duplex printing portion and contains a diverging path 26, a loop path 27A, an inverting path 27B and a re-feeding path 27C. When selecting a both surface image forming mode in which the images are formed on both surfaces of the sheet of paper P, the sheet of paper P, on a surface of which the image has already been formed, transported from the fixing unit 24 is transported into the loop path 27A via diverging paths 26 and then, inverted in the inverting portion 27B. The inverted sheet of paper P is again transported to the secondary transfer portion 12 via the re-feeding path 27C. In the secondary transfer portion 12, the other color image is transferred to the back of the sheet of paper P.

Figure 1A:
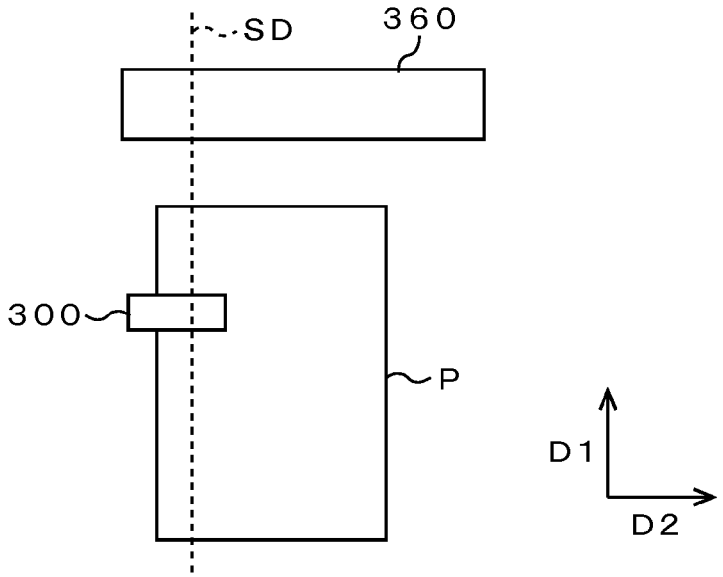
FIG. 1A (RELATED ART)
FIGS. 1A through 1C are diagrams each showing a correction of the deviations of the sheet of paper in a past image forming apparatus.
Figure 1B:
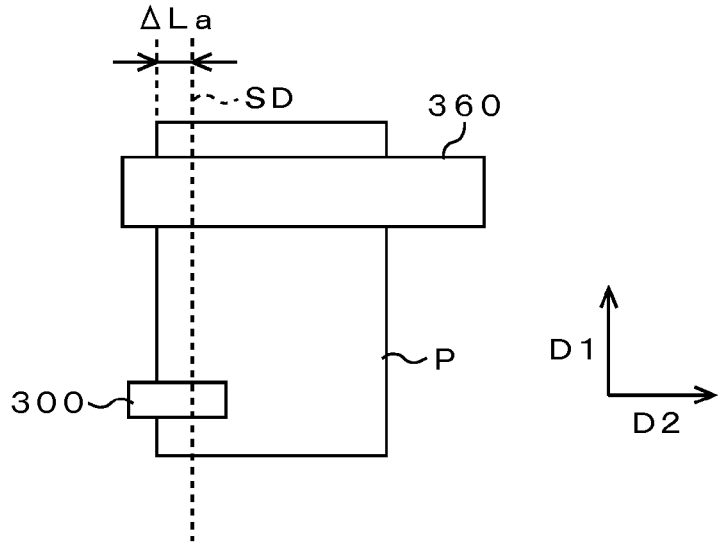
FIG. 1B (RELATED ART)
Figure 1C:
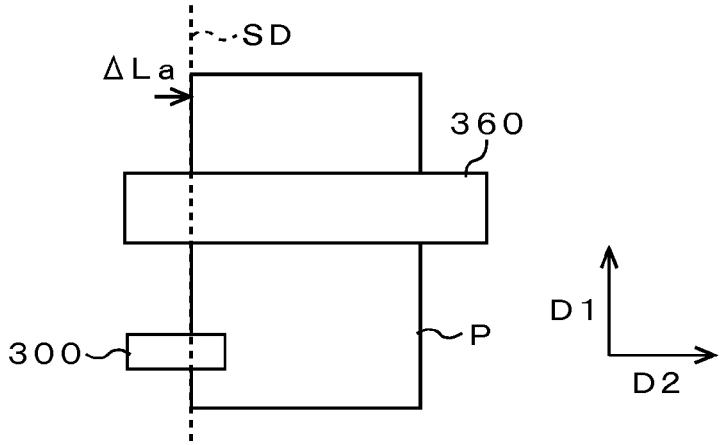
FIG. 1C (RELATED ART)
Figure 2A:
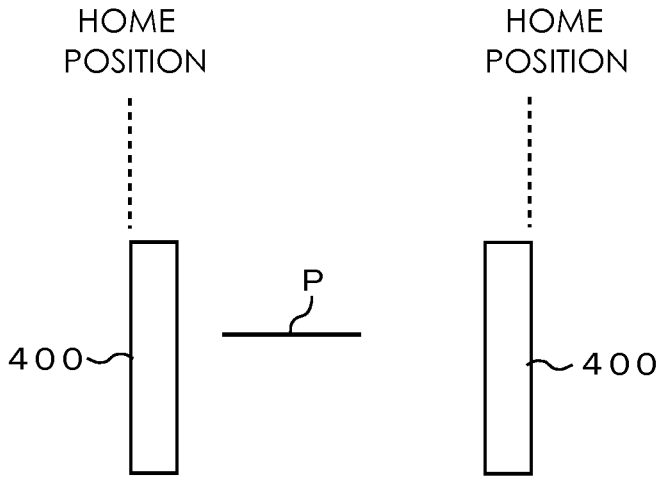
FIG. 2A (RELATED ART)
FIGS. 2A and 2B are diagrams each showing an example of alignment processing of the sheets of paper in a past post-processing device.
Figure 2B:
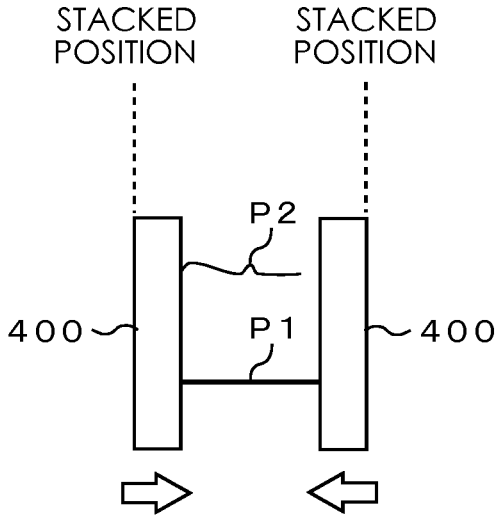
FIG. 2B (RELATED ART)

The post-processing device 200 is positioned at a side of a paper-ejection port of the image forming apparatus 100 with it being adjacent to the image forming apparatus 100. The post-processing device 200 is provided with a stacker 210 which stacks plural sheets of paper P ejected from the image forming apparatus 100. The stacker 210 contains a pair of conveying rollers 212, a pair of conveying rollers 214 and a pair of alignment plates 216. The alignment plates 216, 216 are positioned at their home positions on normal time, which is similar to the alignment processing of sheets of paper in the past post-processing device as shown in FIG. 2, and when predetermined sheets of paper P are put on another, the sheets of paper P are aligned by moving the alignment plates 216, 216 from their home positions to the alignment positions thereof. In this embodiment, since the sheet of paper P having a small paper weight such as thin paper is not shifted, which is different from the alignment processing of sheets of paper in the past post-processing device as shown in FIG. 2, it is possible to prevent such sheets of paper from being transported to the following post-processing device 200 with their reference positions being shifted on the direction D2 that is orthogonal to the transporting direction 1 of the sheets of paper P or it is possible to prevent such sheets of paper from being transported to the following post-processing device 200 with being deviated from the default reference position. Further, the post-processing device 200 has any kinds of mechanisms for performing staple processing, punching processing, folding processing, flat stitch processing, a multi-centre-fold and saddle stitch processing, perfect binder of book processing including gluing and trimming processing in addition to the stacker 210.

Configuration Example of Image Forming System

Figure 4:
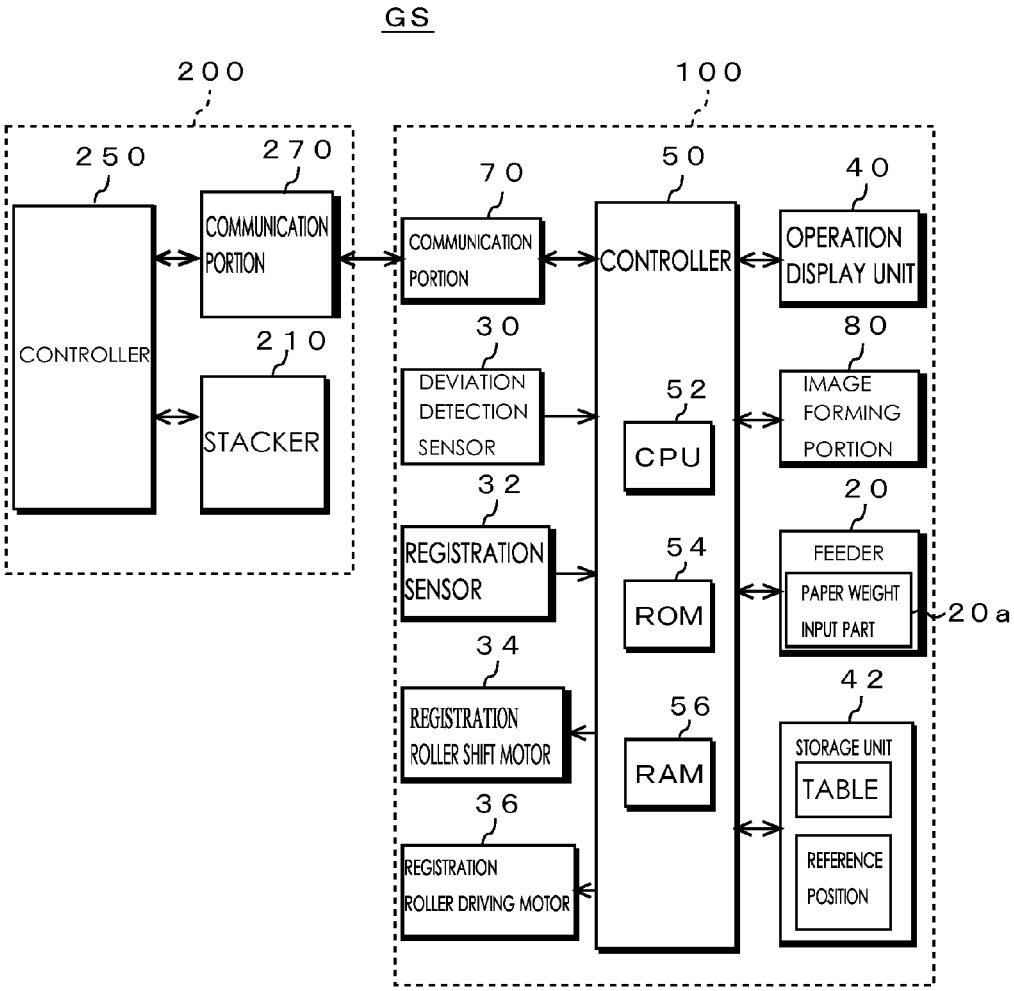
FIG. 4 is a block diagram of the image forming system illustrating a configuration example thereof.

FIG. 4 illustrates a configuration example of the image forming system GS. As shown in FIG. 4, the image forming system GS is provided with the image forming apparatus 100 and the post-processing device 200. The image forming apparatus 100 contains a controller 50 controlling an operation of whole of the image forming apparatus 100. The controller 50 includes a central processing unit (CPU) 52, a read only memory (ROM) 54, a random access memory (RAM) 56 and the like. CPU 52 performs an image forming process, any shift operation controls of the sheet of paper P by the registration and fluctuation unit 60 and/or the like by reading any programs stored in ROM 54 and extracting the programs in the RAM 56 to execute them.

The controller 50 connects the deviation detection sensor 30, the registration sensor 32, a registration roller shift motor 34, a registration roller driving motor 36, an operation display unit 40, a storage unit 42, the image forming portion 80, the feeder 20, and a communication portion 70, respectively.

The deviation detection sensor 30 is composed of, for example, a line sensor in which plural image sensor elements such as CCD are arranged in a longitudinal direction thereof. The deviation detection sensor 30 is positioned at a position which overlaps with, at least, a side end of the sheet of paper P. The deviation detection sensor 30 detects a position through which the side end of the transported sheet of paper P is passed and supplies any positional information of the side end of the sheet of paper P obtained by this detection to the controller 50.

The registration sensor 32 is composed of, for example, a sensor of reflection type. The registration sensor 32 detects the forward end of the sheet of paper P which has been passed through the deviation detection sensor 30 and supplies any detection signal obtained by this detection to the controller 50.

The registration roller shift motor 34 is composed of, for example, a stepping motor or the like. The registration roller shift motor 34 drives based on a driving signal received from the controller 50 to fluctuate the registration and fluctuation unit 60 along the direction D2 that is orthogonal to the transporting direction D2 of the sheet of paper P. This enables the sheet of paper P to be moved to a regular image forming position and prevents the sheet of paper P from being deflected.

The registration roller driving motor 36 is composed of, for example, a stepping motor or the like. The registration roller driving motor 36 drives based on a driving signal received from the controller 50 to rotate or stop the rollers 62 with it being synchronized with any registration correction operations.

The operation display unit 40 is composed of, for example, a touch panel, which combines a positional information input part made of capacitive sensing system or resistive film system and a display part of crystal liquid panel or the like. The operation display unit 40 is provided on an upper front portion of the main body of the image forming apparatus. The operation display unit 40 detects input information based on any input operations by a user and supplies an operation signal to the controller 50. For example, the operation display unit 40 displays an operation screen and receives any information on various kinds of conditions of image forming processing and receives any input information on paper weight of the sheet of paper P set any of the feeding trays 20A through 20C, operation conditions (an amount of shift ΔS, a maximum shiftable amount Sm and a shift cycle T) of shift operations and the like. The paper weight of the sheet of paper P may be determined by setting a thick paper detection sensor on a transporting path and determining it based on a detection result of the detection of this thick paper detection sensor. It is to be noted that this operation display unit 40 and the thick paper detection sensor constitute a paper-weight-acquiring part.

The storage unit 42 is composed of, for example, a semiconductor memory, a hard disk drive (HDD) and the like. The storage unit 42 stores image data generated in the image reading unit based on a control signal received from the controller 50, and information on any previously set reference positions indicating to the references of images and sheets of paper, the shifted reference positions and the like. Further, the storage unit 42 stores a shift table in which any shift information is set correspondingly to each of paper weights of the sheets of paper P classified into plural groups, and any shift information includes the amount of shift ΔS, the maximum shiftable amount Sm and the shift cycle T. Here, the amount of shift ΔS is an amount of movement such that the reference position of the sheet of paper P can be moved by one time on the direction D2 that is orthogonal to the transporting direction D1 of the sheet of paper P. The maximum shiftable amount is an amount indicating the maximum or minimum amount of shift region on the direction D2. The shift cycle T is a number of the sheet(s) of paper included in a single cycle of the shift operation.

The paperweight is classified into, for example, three groups, "paper weight smaller that 100 g/m$^2$", "paper weight of 100 through 250 g/m$^2$" and "paper weight more than 250 g/m$^2$". As the shift information, items of "the amount of shift Δ S=0; the maximum shiftable amount Sm=plus or minus 0; and the shift cycle T=0" corresponding to "paper weight smaller that 100 g/m$^2$" are stored. Items of "the amount of shift ΔS=0.5; the maximum shiftable amount Sm=plus or minus 2; and the shift cycle T=8" corresponding to "paper weight of 100 through 250 g/m$^2$" are stored. Items of "the amount of shift Δ S=1; the maximum shiftable amount Sm=plus or minus 5; and the shift cycle T=10" corresponding to "paper weight more than 250 g/m$^2$" are stored. In other words, in a case of the thick paper, since alignment is easy but is subject to any scratches on the fixing rollers 23, the amount of shift is set so as to be large.

The image forming portion 80 contains the photosensitive drums, the charging portions, the laser units, the developing portions and the fixing unit. The image forming portion 80 controls operations of the photosensitive drums and the like based on the control signal received from the controller 50 and forms a desired image on the sheet of paper P based on, for example, electrographic process. Further, the image forming portion 80 shifts a position to be imaged corresponding to the reference position shifted by the controller 50 to form the desired image on the sheet of paper P.

The communication portion 70 is composed of, for example, a serial communication interface. The communication portion 70 is connected with a controller 250 of the adjoining post-processing device 200 to perform bidirectional communication of data with the post-processing device 200.

The feeder 20 is provided with plural feeding trays 20A, 20B and 20C. The feeder 20 carries the sheet of paper P from a fixed feeding tray based on the control signal received from the controller 50 and transports it to the secondary transfer portion 12 via the conveying rollers or the like. Each of the feeding trays 20A, 20B and 20C may contain a paper weight input part 20*a* for inputting the paper weight of the sheet of paper P contained in each of the feeding trays. The paper weights of the sheets of paper P input by the paper weight input part 20*a* are supplied to the controller 50 with being corresponding to any sheets of paper contained in the feeding trays and stored in the storage unit 42. It is to be noted that the paper weight input part 20*a* constitutes the paper-weight-acquiring part.

The post-processing device 200 is provided with the controller 250, a stacker 210 and a communication portion 270. The controller 250 controls an operation of whole of the post-processing device 200 to perform stacking, staple processing, punching or the like. The controller 250 is composed of CPU, ROM, RAM and the like, which is similar to the image forming apparatus 100.

The stacker 210 has a pair of alignment plates 216 which are moved to the alignment positions from their home positions based on the control signal received from the controller 250 to perform the alignment of the sheets of paper P ejected from the image forming apparatus 100. The communication portion 270 is composed of, for example, a serial communication interface. The communication portion 270 is connected with a controller 50 of the adjoining image forming apparatus 100 to perform bidirectional communication of data with the image forming apparatus 100.

Shifted Example of Reference Position

Figure 5A:
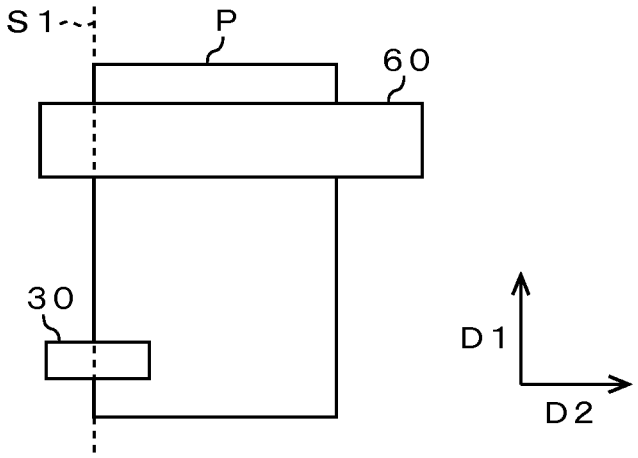
FIGS. 5A through 5C are diagrams each showing an example of a shift operation of the sheet of paper in relation to a reference position.
Figure 5B:
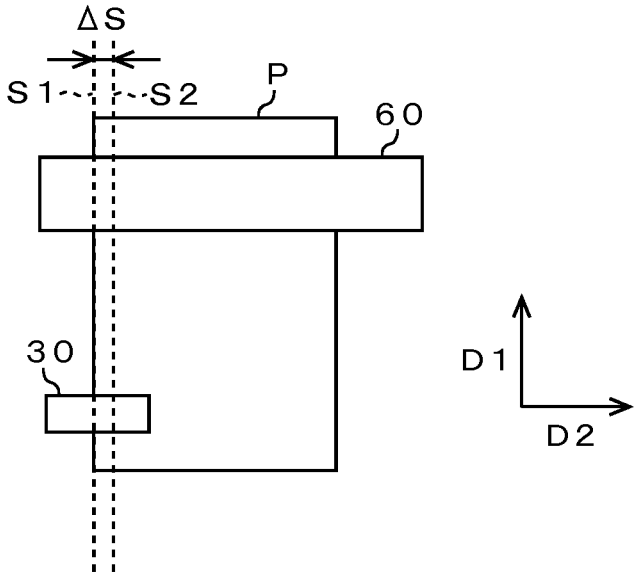
Figure 5C:
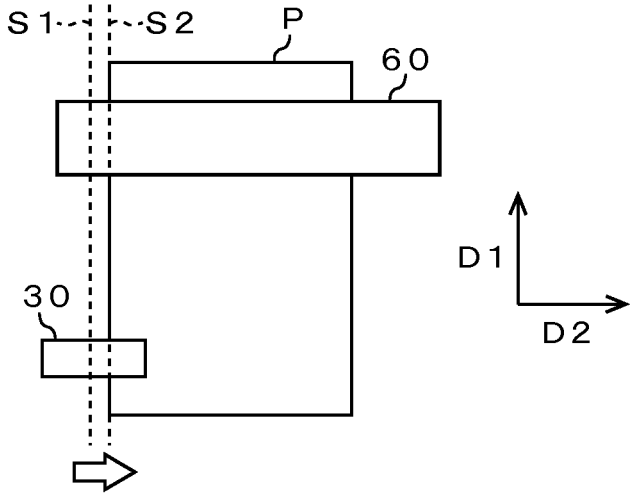
Figure 6:
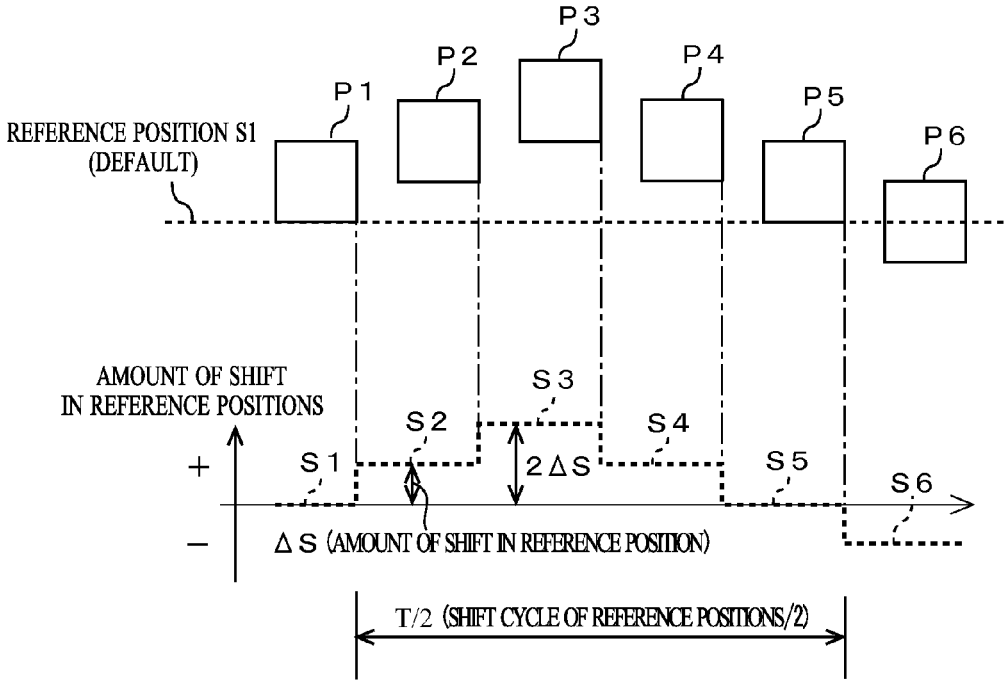
FIG. 6 is a diagram showing a shift cycle when the reference positions are shifted.

The following will describe examples of a shift operation of the reference position based on the paper weight of the sheet of paper P. FIGS. 5A through 5C show an example of the shift operation of the sheet of paper P in relation to the reference position. FIG. 6 shows an example of the shift cycle when the reference positions are shifted. In FIG. 6, the upward shift is set to be plus shift and the downward shift is set to be minus shift.

When the registration sensor 32 detects the sheet of paper P, the controller 50 acquires paper weight of the sheet of paper P from a storage portion 42 or a paper thickness detection sensor set on the transporting path. The storage portion 42 stores information on, for example, the paper weight set by the user on the paper weight input part 20*a* of the feeder 20 or the paper weight input by the user on the operation screen of the operation display unit 40.

As shown in FIGS. 5A and 5B, the controller 50 acquires an amount of shift ΔS of the sheet of paper P based on the acquired paper weight by referring to the table of the storage portion 42 and sets the reference position so as to shift the reference position S1 to a reference position S2 by the acquired amount of shift ΔS. For example, when the acquired paper weight is smaller than a previously set reference paper weight, the controller 50 sets the amount of shift to be zero. When the acquired paper weight is not smaller than the previously set reference paper weight, the controller 50 sets the amount of shift to correspond to the acquired paper weight. This is because when the sheet of paper P has a small paper weight, the sheet of paper P is flexible so that by such sheet of paper P, the fixing rollers 23 are not subject to any scratches but the sheet of paper P is foldable and bendable during the alignment processing in the stacker 210 of the post-processing device 200 and the sheets of paper P fail to be aligned with high accuracy. On the other hand, this is because when the sheet of paper P has a large paper weight, the sheet of paper P is stiff so that by such sheet of paper P, the fixing rollers 23 are subject to any scratches but the sheet of paper P is not foldable and bendable during the alignment processing in the stacker 210 of the post-processing device 200 and the sheets of paper P are aligned with high accuracy. As shown in FIG. 5C, the controller 50 controls the registration and fluctuation unit 60 to be fluctuated to the direction D2 that is orthogonal to the transporting direction D1 of the sheet of paper P based on the detection result of the sheet of paper P by the deviation detection sensor 30 and to shift the sheet of paper P to the reference position S2.

As shown in FIG. 6, when, for example, a series of the six sheets of paper P each having large paper weight is transported successively to the registration and fluctuation unit 60, the controller 50 first sets a reference position of a first sheet of paper P1 to be set on, for example, a default reference position S1. The transported first sheet of paper P1 is then transported to the secondary transfer portion 12 with its side end being aligned to the reference position S1 based on the detection result of the deviation detection sensor 30.

The controller 50 then sets a reference position of a second sheet of paper P2 to be set on a reference position S2 which is shifted by an amount of shift ΔS from the reference position S1 of the first sheet of paper P1 toward the plus direction. The transported second sheet of paper P2 is then transported to the secondary transfer portion 12 with its side end being aligned to the reference position S2 based on the detection result of the deviation detection sensor 30. Similar shift operations are performed on a third sheet of paper P3 or later.

When setting the maximum shiftable amount Sm in relation to the default reference position S1 along the plus or minus direction, the controller 50 inverts sign of the shift direction of sheet of paper P when the shifted reference position reaches the maximum shiftable amount Sm. For example, when setting the maximum shiftable amount Sm to be 2 ΔS, the shifted reference position reaches the maximum shiftable amount Sm at a third sheet of paper P3. The controller 50 inverts the sign of the shift direction of a fourth sheet of paper P4 to minus. The controller 50 sets the reference position of the fourth sheet of paper P4 to be a reference position S4 which is shifted by an amount of shift ΔS from the reference position S3 of the third sheet of paper P3 toward the minus direction. The transported fourth sheet of paper P4 is then transported to the secondary transfer portion 12 with its side end being aligned to the reference position S4 based on the detection result of the deviation detection sensor 30.

Similarly, such a shift operation is also performed in the minus direction. When the shifted reference position reaches the maximum shiftable amount Sm on the minus direction, the controller 50 inverts the sign of the shift direction of sheet of paper P to plus and performs the shift operation. By setting the maximum shiftable amount Sm, it is possible to change the amounts of shift ΔS and the reference positions periodically, as shown in FIG. 6. It is possible to change the amount of shift ΔS and the shift cycle T based on the paper weight of the sheet of paper P. Even if the maximum shiftable amount Sm is not set, by setting the amount of shift ΔS and the shift cycle T, it is possible to change the reference positions periodically. Of course, the amount of shift ΔS may be changed at random, not periodically.

Example of Operation of Image Forming System

Figure 7:
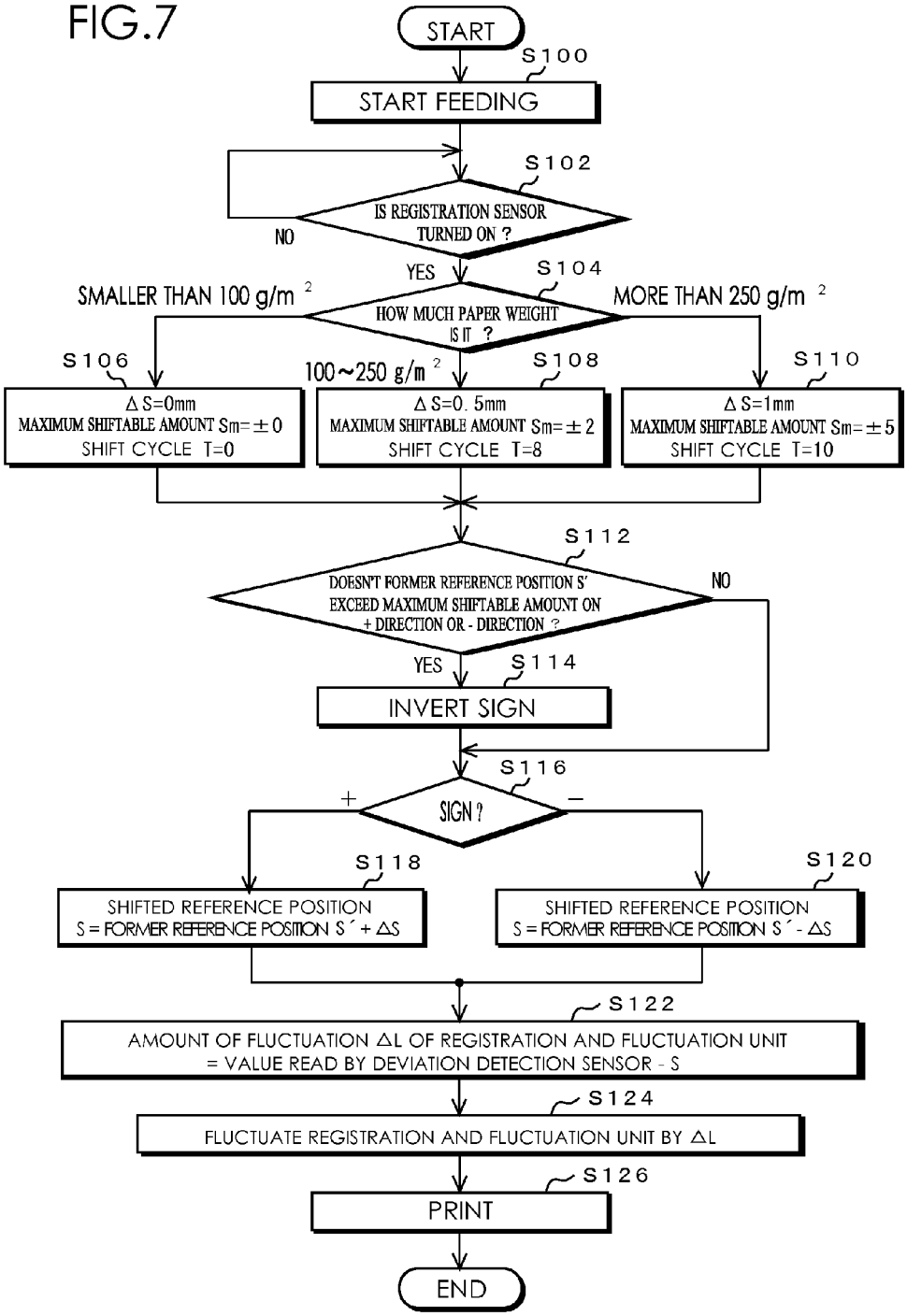
FIG. 7 is a flowchart showing an operation example of the image forming apparatus.

The following will describe an example of an operation of the controller 50 in the shift operation of the image forming system GS. FIG. 7 shows an exemplary shift operation of the controller 50 in the image forming apparatus 100 at the shift operation thereof.

As shown in FIG. 7, at a step S100, the controller 50 starts feeding of the sheet of paper P based on an input of print job by a user. The controller 50 controls the conveying rollers 22B, 22C and the like to transport the sheet of paper P to secondary transfer portion 12 from a feeding tray selected by the user. When the sheet of paper P is fed, the controller 50 then goes to a step S102.

At the step S102, the controller 50 determines whether or not the registration sensor 32 is turned on by passing the forward end of the fed sheet of paper P through the registration sensor 32. When the registration sensor 32 is turned on, the controller 50 then goes to a step S104. When the registration sensor 32 is not turned on, the controller 50 continues to watch a state of the registration sensor 32.

At the step S104, the controller 50 acquires the paper weight of the sheet of paper P which the registration sensor 32 detects and identifies or classifies the acquired paper weight of the sheets of paper P. When the acquired paper weight of the sheet of paper P is smaller than 100 g/m$^2$, the controller 50 then goes to a step S106. When the acquired paper weight of the sheet of paper P is within a range of 100 g/m$^2$ through 250 g/m$^2$, the controller 50 then goes to a step S108. When the acquired paper weight of the sheet of paper P is more than 250 g/m$^2$, the controller 50 then goes to a step S110.

When the acquired paper weight of the sheet of paper P is smaller than 100 g/m$^2$, at the step S106, the controller 50 determines that the sheet of paper P is thin paper and reads the shift information corresponding to a case where the paperweight of the sheet of paper P is smaller than 100 g/m$^2$ from the table of the storage unit 42. In the shift information, there are items of the amount of shift ΔS=0; the maximum shiftable amount Sm=plus or minus 0; and the shift cycle T=0. Further, when the controller 50 determines that a condition of the sheets of paper is changed, for example, the transported sheet of paper is changed from the one having the paper weight which is not smaller than 100 g/m$^2$ to the one having the paper weight which is smaller than 100 g/m$^2$, the controller 50 shifts the former reference position S' to the default reference position S1 of the sheet of paper P having the paper weight which is smaller than 100 g/m$^2$. This enables the sheet of paper P having the paperweight which is smaller than 100 g/m$^2$ to be transported to the post-processing device 200 with the sheet of paper P passing through the default reference position by setting the amount of shift to be zero.

When the acquired paper weight of the sheet of paper P is within a range of 100 through 250 g/m$^2$, at the step S108, the controller 50 determines that the sheet of paper P is plain paper and reads the shift information corresponding to a case where the paper weight of the sheet of paper P is within a range of 100 through 250 g/m$^2$ from the table of the storage unit 42. In the shift information, there are items of the amount of shift ΔS=0.5; the maximum shiftable amount Sm=plus or minus 2; and the shift cycle T=8.

When the acquired paper weight of the sheet of paper P is more than 250 g/m$^2$, at the step S110, the controller 50 determines that the sheet of paper P is thick paper and reads the shift information corresponding to a case where the paper weight of the sheet of paper P is more than 250 g/m$^2$ from the table of the storage unit 42. In the shift information, there are items of the amount of shift ΔS=1; the maximum shiftable amount Sm=plus or minus 5; and the shift cycle T=10.

At the step S112, the controller 50 determines if the former reference position S' does not exceed the maximum shiftable amount on the plus direction or the minus direction. When the controller 50 determines that the former reference position S' exceeds the maximum shiftable amount on the plus direction or the minus direction, the controller 50 goes to a step S114. When the controller 50 determines that the former reference position S' does not exceed the maximum shiftable amount on the plus direction or the minus direction, the controller 50 goes to a step S116.

At the step S114, the controller 50 inverts the sign, plus or minus of the amount of shift ΔS on the shift direction. For example, when the shift direction of the amount of shift ΔS is plus and the former reference position S' exceeds the maximum shiftable amount on the plus direction, the controller 50 inverts the sign of the amount of shift ΔS from plus to minus. When inverting the operator, the controller 50 goes to a step S116.

At the step S116, the controller 50 determines if the operator of the amount of shift ΔS is plus or minus. When the sign of the amount of shift ΔS is plus, the controller 50 goes to a step S118. When the sign of the amount of shift ΔS is minus, the controller 50 goes to a step S120.

When the operator of the amount of shift ΔS is plus, at the step S118, the controller 50 adds the amount of shift ΔS acquired at the step S106, S108 or S110 based on the paperweight of the sheet of paper P to the former reference position S', thereby calculating the shifted reference position S of this time. When acquiring the shifted reference position S, the controller 50 goes to a step S122.

On the other hand, when the sign of the amount of shift ΔS is minus, at the step S120, the controller 50 subtracts the amount of shift ΔS acquired at the step S106, S108 or S110 based on the paper weight of the sheet of paper P from the former reference position S', thereby calculating the shifted reference position S of this time. When acquiring the shifted reference position S, the controller 50 goes to a step S122.

At the step S122, the controller 50 calculates an amount of fluctuation ΔL of the registration and fluctuation unit 60. Specifically, the controller 50 subtracts the shifted reference position S from the position of the sheet of paper P detected by the deviation detection sensor 30 (the value read by the deviation detection sensor) to calculate the amount of fluctuation ΔL of the registration and fluctuation unit 60.
When obtaining the amount of fluctuation ΔL, the controller 50 goes to a step S124.

At the step S124, the controller 50 controls the operation of the registration and fluctuation unit 60 to fluctuate the sheet of paper P to the direction D2 that is orthogonal to the transporting direction D1 of the sheet of paper P. The registration and fluctuation unit 60 nips the sheet of paper P based on instructions of the controller 50 and fluctuates the sheet of paper P by the amount of fluctuation ΔL to the direction D2 that is orthogonal to the transporting direction D1 of the sheet of paper P. For example, when the paper weight of the sheet of paper P is smaller than 100 g/m$^2$, the controller 50 shifts the sheet of paper P back to the default reference position.

At the step S126, the controller 50 controls the image forming portion 80 to shift a position to be imaged so as to correspond to an image position on the sheet of paper P fluctuated to the orthogonal direction D2 by the registration and fluctuation unit 60 and to print the desired image on the sheet of paper P. Such a shift operation is repeated corresponding to any of the paper weights of the sheets of paper P.

As described above, according to the first embodiment thereof, since the controller 50 adjusts the amount of shift corresponding to the paper weight of the sheet of paper P, it is possible to perform alignment processing in the post-processing device 200 with high accuracy and it is possible to prevent the fixing rollers 23 from being scratched by edges of the sheets of paper P. Namely, for example, when the sheet of paper P has a small paper weight and is flexible, the amount of shift ΔS is limited to a very small one or zero so that the sheet of paper P can be transported to the post-processing device 200 with its reference position being deviated by a very small amount thereof. This enables the flexible sheets of paper P to be aligned in the post-processing device 200 with high accuracy. When the sheet of paper P has a small paperweight and is flexible, the fixing rollers 23 are not subject to any scratches so that the fixing rollers 23 can be prevented from being scratched even if the amount of shift is very small or zero. On the other hand, when the sheet of paper P has a large paper weight and is stiff, the sheets of paper P are aligned in the post-processing device 200 by the movement of the alignment plates 216 even if they have large amounts of shift ΔS, which has no influence on the alignment in the post-processing device 200. Thus, when the sheet of paper P has a large paper weight and is stiff, their amounts of shift are set so as to be large so that it is possible to avoid passing through the same position in the fixing rollers 23, thereby preventing the fixing rollers 23 from being scratched and enabling the alignment accuracy in the post-processing device 200 to be maintained. As a result thereof, an exchange span of the fixing rollers 23 can be extended so that running costs can be limited.

Second Embodiment

The second embodiment is different from the first embodiment in that an amount of shift of the sheet of paper P alters based on a size of a width of the sheet of paper P, in place of alteration of the amount of shift based on the paper weight of the sheet of paper P in the first embodiment. It is to be noted that other components and operations of the image forming system GS in this embodiment are identical to those of the first embodiment so that the identical components are indicated by the same reference numbers, a detailed explanation of which will be omitted.

Configuration Example of Image Forming Apparatus

The storage unit 42 constituting the image forming apparatus 100 stores a table in which any shift information is set correspondingly to each of sizes of the widths of sheets of paper P classified into plural cases. For example, the sizes of the widths of sheets of paper P are classified into two groups: they are classified into a case where the size of the width of sheets of paper P is 250 mm or more, which is determined as a flexible sheet of paper, and a case where the size of the width of sheets of paper P is smaller 250 mm, which is determined as a stiff sheet of paper, as a border of 250 mm that is a reference of the stiffness of the sheet of paper P. As the shift information, for example, items of an amount of shift ΔS=0.5, maximum shiftable amount Sm=plus or minus 2 and shift cycle=8 are stored corresponding to the sheet of paper P having the size of 250 mm or more. Further, as the other shift information, for example, items of an amount of shift ΔS=1, maximum shiftable amount Sm=plus or minus 5 and shift cycle=10, are stored corresponding to the sheet of paper P having the size that is smaller than 250 mm.

A size detection sensor may be set at an upstream side of the deviation detection sensor 30 along the transporting direction D1 of the sheet of paper P as a sheet-width-acquiring part that acquires the size of the width of sheet of paper P. The image forming apparatus 100 may acquire the size of the width of sheet of paper P based on the detection result of the size detection sensor. Further, the paper weight input part 20*a* of the above-mentioned feeder 20 may be used as an input part of the sheet-width-acquiring part and the size of the width of sheet of paper P may be acquired by the input part. A user may input the size of the width of sheet of paper P using the operation screen of the operation display unit 40. It is to be noted that the size detection sensor, the paper weight input part 20*a* and the operation display unit 40 constitute the sheet-width-acquiring part.

Operation Example of Image Forming Apparatus

Figure 8:
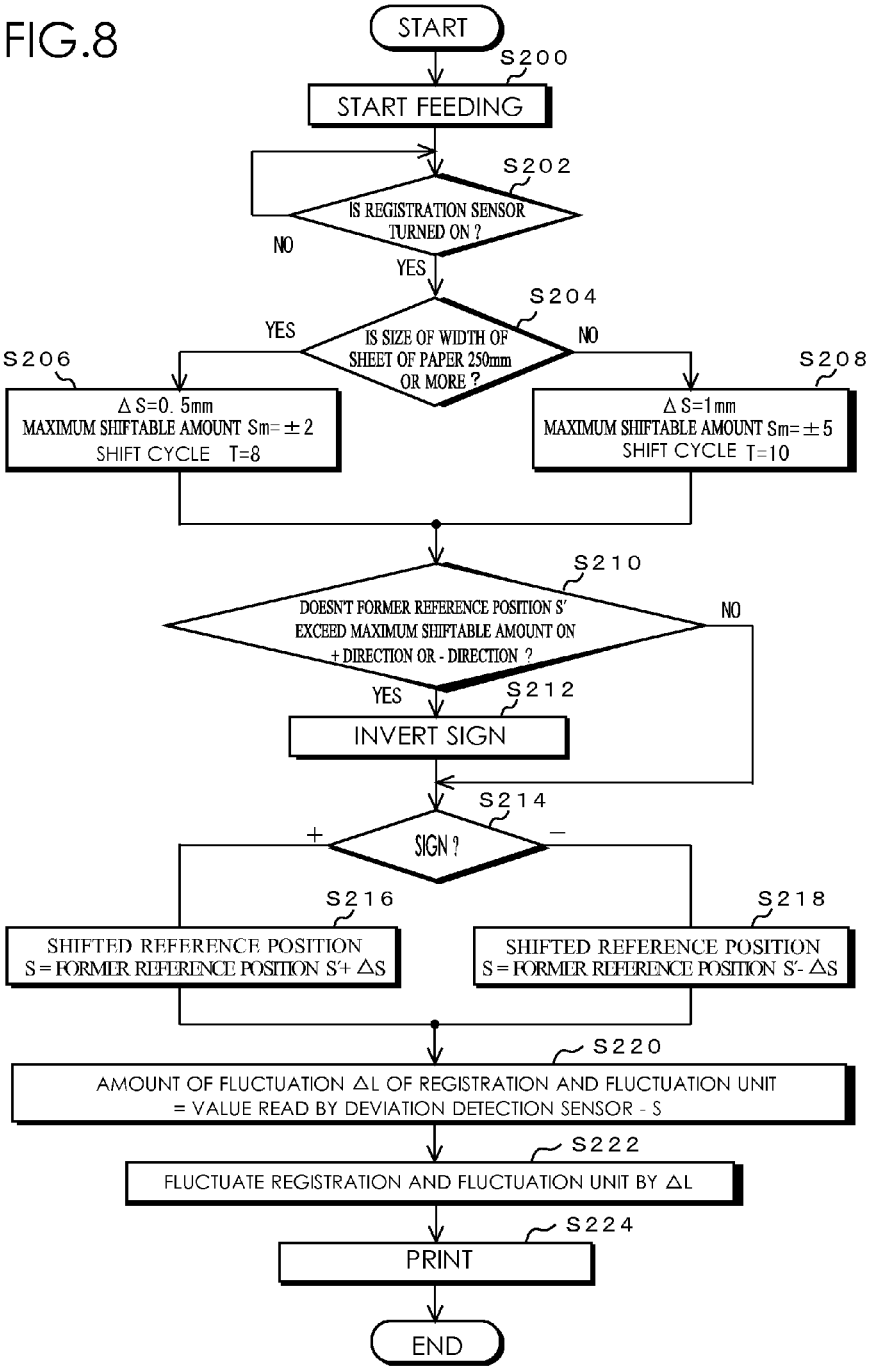
FIG. 8 is a flowchart showing an operation example of the image forming apparatus according to a second embodiment of this invention.

FIG. 8 is a flowchart showing an operation example of the image forming apparatus 100 according to a second embodiment of the present invention when the controller 50 performs the shift operation. Operations of the controller 50 at the steps S200, S202 and S210 through S224 are similar to those at the steps S100, S102 and S112 through S126, as shown in FIG. 7, of the above-mentioned first embodiment, an explanation of which will be simplified or omitted.

As shown in FIG. 8, at the step S200, the controller 50 receives a print job based on an instruction of a user and starts feeding of the desired sheet of paper P from the feeder 20. The controller 50 then controls the conveying rollers 22B, 22C and the like to transport the sheet of paper P to secondary transfer portion 12. The registration sensor 32 is turned on when the forward end of the sheet of paper P is passed therethrough at the step S202. The controller 50 acquires the size of the width of sheet of paper P, which the registration sensor 32 detects and determines whether or not the acquired size of the width of sheet of paper P is 250 mm or more at a step S204. The size of the width of sheet of paper P is acquired from a detection result of the size detection sensor set on an upstream side of the deviation detection sensor 30 along the transporting direction D1 of the sheet of paper P or it is acquired from the storage unit 42. The storage unit 42 stores the sizes of the widths of sheets of paper P input in the sheet-width-acquiring part (the paper weight input part 20*a*) of the feeder 20 and/or the sizes of the widths of sheets of paper P input by the user using the operation screen of the operation display unit 40.

When the size of the width of sheet of paper P is 250 mm or more, at a step S206, the controller 50 determines that the sheet of paper P is flexible based on the size of the width of sheet of paper P and reads any shift information corresponding to the width of sheet of paper P of 250 mm or more by referring to the table in the storage unit 42. This shift information is, for example, an amount of shift ΔS=0.5, maximum shiftable amount Sm=plus or minus 2 and shift cycle=8.

When the size of the width of sheet of paper P is smaller 250 mm, at a step S208, the controller 50 determines that the sheet of paper P is stiff based on the size of the width of sheet of paper P and reads any shift information corresponding to the width of sheet of paper P that is smaller 250 mm by referring to the table in the storage unit 42. This shift information is, for example, an amount of shift ΔS=1, maximum shiftable amount Sm=plus or minus 5 and shift cycle=10.

The following shift operation is similar to that of the first embodiment. The controller 50 calculates the shifted reference position of the sheet of paper P corresponding to each of the sheets of paper P by adding the acquired amount of shift ΔS to the former reference position S' or subtracting the acquired amount of shift ΔS from the former reference position S', at the steps 210 through S218. The controller 50 then subtracts the acquired shifted reference position S from the position of the sheet of paper detected by the deviation detection sensor 30 to calculate an amount of fluctuation ΔL of the registration and fluctuation unit 60 at a step S220. The controller 50 then performs a shift correction of the sheet of paper P on the orthogonal direction D2 at a step S222.

As described above, according the second embodiment, since the controller 50 adjusts the amount of shift corresponding to the sizes of the widths of the sheets of paper P, it is possible to perform alignment processing in the post-processing device 200 with high accuracy and it is possible to prevent the fixing rollers 23 from being scratched by edges of the sheets of paper P. Namely, for example, when the sheet of paper P has a large size of the width of sheet of paper and is flexible, the amount of shift ΔS is limited to the one which is smaller than a narrow sheet of paper so that the sheet of paper P can be transported to the post-processing device 200 with its reference position being deviated by a small amount of deviation. This enables the flexible sheets of paper P to be aligned in the post-processing device 200 with high accuracy. On the other hand, when the sheet of paper P has a small size and is stiff, the amount of shift ΔS is set so as to be larger than a wide sheet of paper and such a sheet of paper is transported to the post-processing device 200 so that it is possible to avoid passing through the same position in the fixing rollers 23, thereby surely preventing the fixing rollers 23 from being scratched. Since the sheet of paper is stiff, when the sheets of paper are transported in the post-processing device 200 with their reference positions being deviated, this has no influence on the alignment in the post-processing device 200, thereby enabling the high alignment accuracy in the post-processing device 200 to be maintained.

Third Embodiment

The third embodiment is different from the first embodiment in that an amount of shift of the sheet of paper P alters based on a transporting speed of the sheet of paper P, in place of alteration of the amount of shift based on the paper weight of the sheet of paper P in the first embodiment. It is to be noted that other components and operations of the image forming system GS in this embodiment are identical to those of the first embodiment so that the identical components are indicated by the same reference numbers, a detailed explanation of which will be omitted.

Configuration Example of Image Forming Apparatus

The image forming apparatus 100 has plural transporting speeds which are set for every paperweight of sheet of paper P. Therefore, when the user selects the sheet of paper (for example, the paper weight is input by the paper weight input part 20*a*), the transporting speed is automatically fixed. The user may set the transporting speed on which the sheet of paper P is transported, at will based on the productivity thereof or the like by operating the operation screen of the operation display unit 40. Further, a speed detection sensor is set on the transporting path and any information on the transporting speed on which the sheet of paper P is transported may be acquired on the basis of a detection result of the speed detection sensor. It is to be noted that the transporting speed indicates an example of the transporting condition of the transported sheet of paper and the paper weight input part 20*a* and the operation display unit 40 constitute a speed-acquiring part.

The storage unit 42 stores a table in which any shift information is set correspondingly to each of plural transporting speeds set for every paper weight. The storage unit 42 also stores any information on the reference speed which is used for determining whether or not the transporting speed on which the sheet of paper P is transported in the shift operation exceeds the reference speed. The information on the reference speed may be previously stored in the storage unit 42 at a shipping stage. The user may input the information on the reference speed by operating the operation screen displayed in the operation display unit 40.

Operation Example of Image Forming Apparatus

Figure 9:
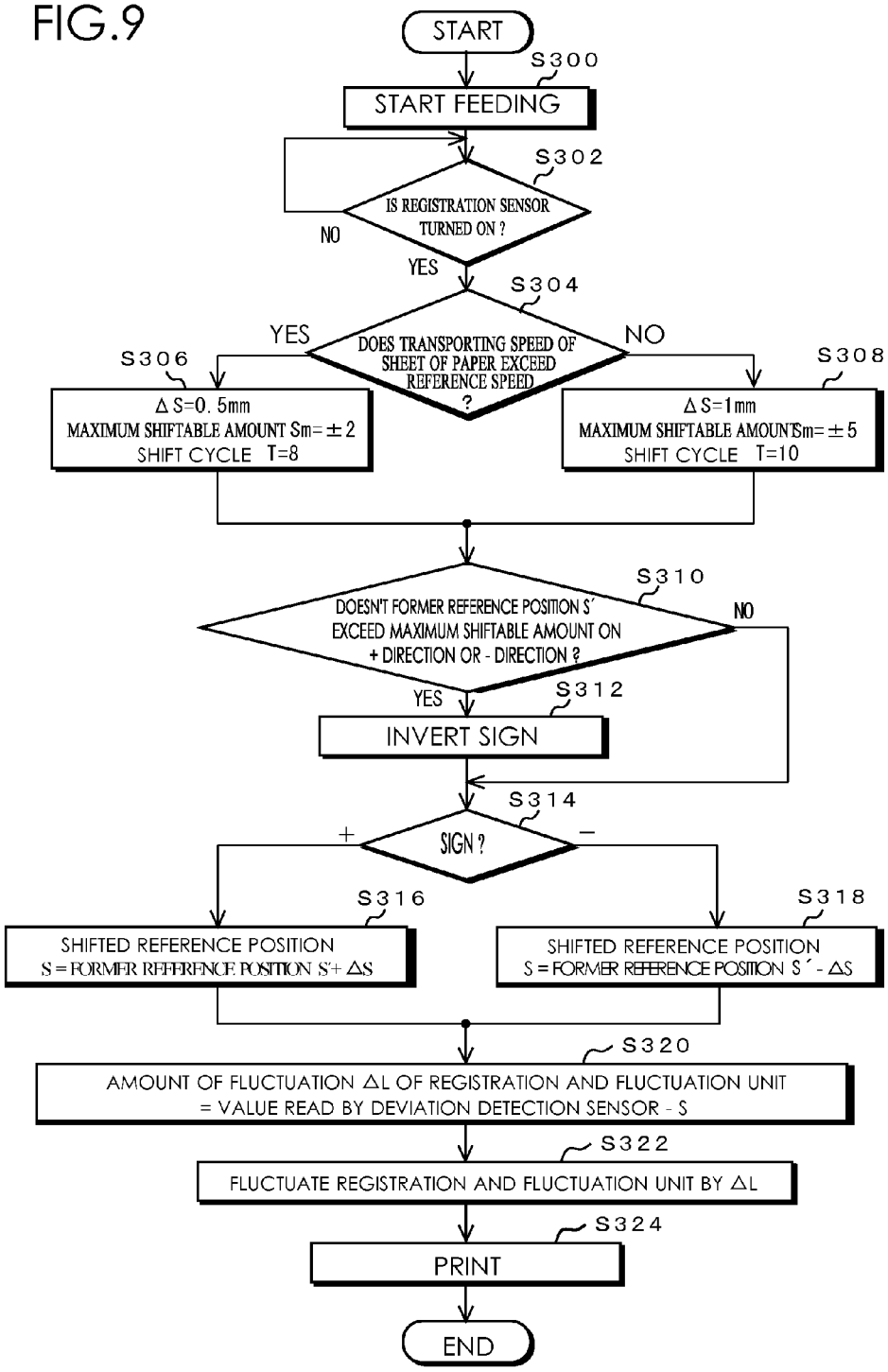
FIG. 9 is a flowchart showing an operation example of the image forming apparatus according to a third embodiment of this invention.

FIG. 9 is a flowchart showing an operation example of the image forming apparatus 100 according to a third embodiment of the present invention. Operations of the controller 50 at the steps S300, S302 and S310 through S324 are similar to those at the steps S100, S102 and S112 through S126, as shown in FIG. 7, of the above-mentioned first embodiment, an explanation of which will be simplified or omitted.

As shown in FIG. 9, at the step S300, the controller 50 receives a print job based on an instruction of a user and starts feeding of the desired sheet of paper P from the feeder 20. The controller 50 then controls the conveying rollers 22B, 22C and the like to transport the sheet of paper P to secondary transfer portion 12. The registration sensor 32 is then turned on when the forward end of the sheet of paper P is passed therethrough at the step S302. The controller 50 acquires the information on the transporting speed on which the sheet of paper P is transported, detected by the registration sensor 32, and determines whether or not the transporting speed on which the sheet of paper P is transported in the shift operation exceeds the reference speed at a step S304. The information on the transporting speed may be acquired from the storage unit 42. When the controller 50 determines that the acquired transporting speed exceeds the previously set reference speed, the controller goes to a step S306. When the controller 50 determines that the acquired transporting speed does not exceed the previously set reference speed, the controller goes to a step S308.

When the transporting speed on which the sheet of paper P is transported exceeds the reference speed, at the step S306, the controller 50 reads shift information corresponding to a case of rapid transporting speed by referring to the table in the storage unit 42. This shift information is, for example, an amount of shift ΔS=0.5, maximum shiftable amount Sm=plus or minus 2 and shift cycle=8. In this shift information, the amount of shift ΔS is set to be smaller than that of a case of slow transporting speed because an interval between the fed sheets of paper is short in a case of rapid transporting speed.

On the other hand, when the transporting speed on which the sheet of paper P is transported does not exceed the reference speed, at the step S308, the controller 50 reads shift information corresponding to a case of slow transporting speed by referring to the table in the storage unit 42. This shift information is, for example, an amount of shift ΔS=1, maximum shiftable amount Sm=plus or minus 5 and shift cycle=10. In this shift information, the amount of shift ΔS is set to be larger than that of a case of rapid transporting speed because a period of shift operation time can be maintained in a case of slow transporting speed.

The following shift operation is similar to that of the first embodiment. The controller 50 calculates the shifted reference position of the sheet of paper P corresponding to each of the sheets of paper P by adding the acquired amount of shift ΔS to the former reference position S' or subtracting the acquired amount of shift ΔS from the former reference position S', at the steps 310 through S318. The controller 50 then subtracts the shifted reference position S from the position of the sheet of paper detected by the deviation detection sensor 30 to calculate an amount of fluctuation ΔL of the registration and fluctuation unit 60 at a step S320.

The controller 50 then performs a shift correction of the sheet of paper P on the orthogonal direction D2 at a step S322.

As described above, according the third embodiment, since the controller 50 limits the amount of shift ΔS so as to be small and perform the shift operation when the transporting speed on which the sheet of paper P is transported is rapid and the interval between the sheet of paper P and the next sheet of paper P is short, any deviated transport is avoided so that it is possible to perform alignment in the post-processing device 200 with high accuracy. Since the shift operation is performed simultaneously, it is possible to prevent the fixing rollers 23 from being scratched by edges of the sheets of paper P. On the other hand, when the transporting speed on which the sheet of paper P is transported is slow, the interval between the sheet of paper P and the next sheet of paper P is long so that a period of shift operation time may be maintained. Thus, by setting the amount of shift ΔS so as to be large, it is possible to prevent the fixing rollers 23 from being scratched by edges of the sheets of paper P surely.

In addition to the control of the amount of shift of the sheet of paper P based on the transporting speed on which the sheet of paper P is transported, it is possible to control the amount of shift of the sheet of paper P based on the paper weight of the sheet of paper P and/or the size of the width of the sheet of paper described in the first and second embodiments. For example, when the transporting speed on which the sheet of paper P is transported is slow, the paper weight of the sheet of paper P is smaller than the reference paper weight and the size of the width of the sheet of paper is larger than the reference size of the width of the sheet of paper, the controller 50 may set the set amount of shift to be small because the sheet of paper P is flexible.

Fourth Embodiment

The fourth embodiment is different from the first embodiment in that when performing duplex printing, the shift operation is performed on a front or a back of the sheet of paper P. It is to be noted that other components and operations of the image forming system GS in this embodiment are identical to those of the first embodiment so that the identical components are indicated by the same reference numbers, a detailed explanation of which will be omitted.

Configuration Example of Image Forming Apparatus

The storage unit 42 stores a table in which any shift information is set correspondingly to each of the transporting conditions indicating the front and the back of the sheet of paper P. The storage unit 42 stores, as the shift information corresponding to the transporting condition indicating the front of the sheet of paper P, items of an amount of shift ΔS=1, maximum shiftable amount Sm=plus or minus 5 and shift cycle=10 are stored. Further, the storage unit 42 stores, as the shift information corresponding to the transporting condition indicating the back of the sheet of paper P, any programs such as a formula for shifting the former reference position S' to the default reference position S1. For example, as the formula, "the amount of shift ΔS=the former reference position S'−the default reference position S1" is exemplified.

Operation Example of Image Forming Apparatus

Figure 10:
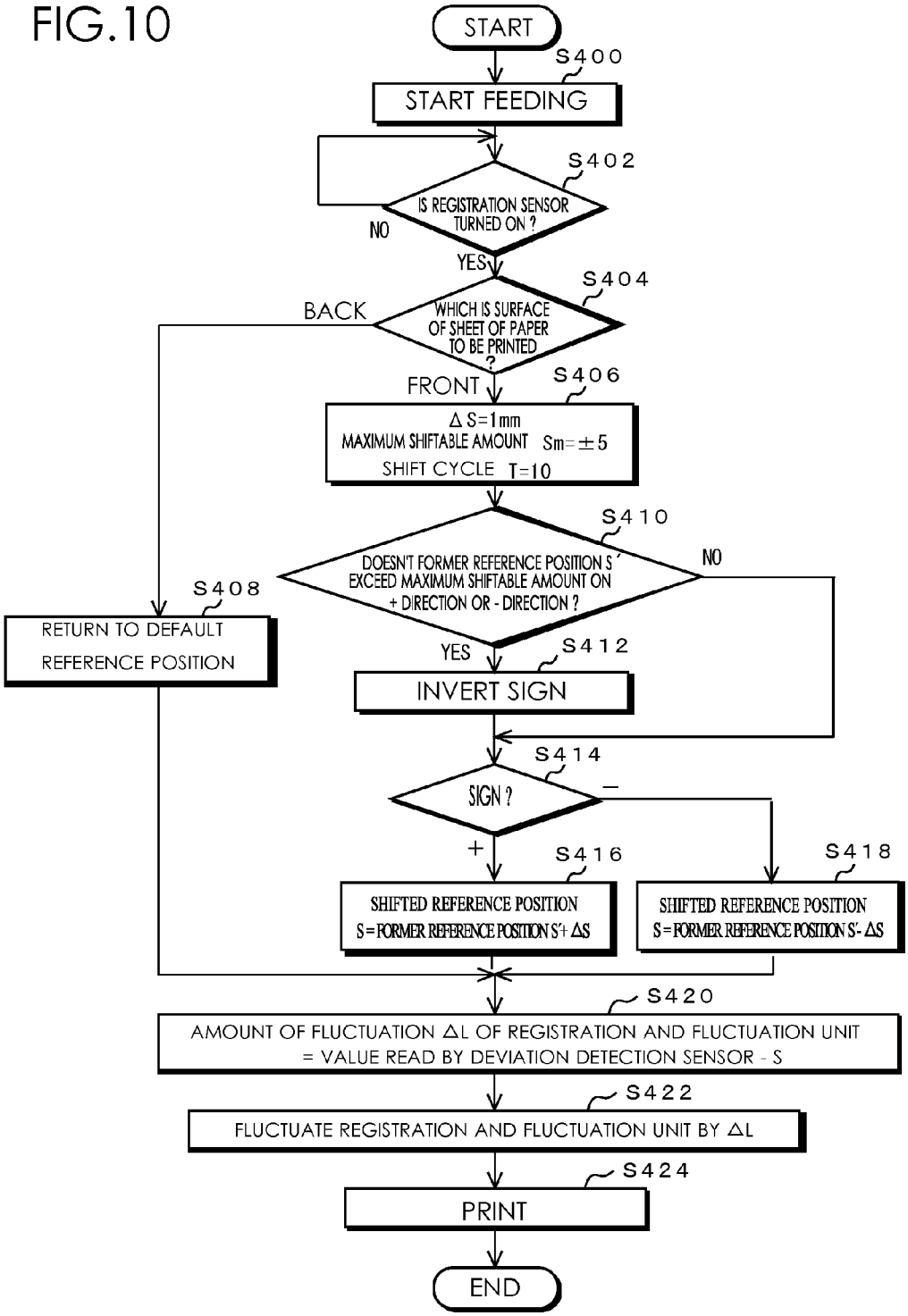
FIG. 10 is a flowchart showing an operation example of the image forming apparatus according to a fourth embodiment of this invention.

FIG. 10 is a flowchart showing an operation example of the image forming apparatus 100 according to a fourth embodiment of the present invention. Operations of the controller 50 at the steps S400, S402 and S410 through S424 are similar to those at the steps S100, S102 and S112 through S126, as shown in FIG. 7, of the above-mentioned first embodiment, an explanation of which will be simplified or omitted.

As shown in FIG. 10, at the step S400, the controller 50 receives a print job based on an instruction of a user and starts feeding of the desired sheet of paper P from the feeder 20. The controller 50 then controls the conveying rollers 22B, 22C and the like to transport the sheet of paper P to secondary transfer portion 12. The registration sensor 32 is turned on when the forward end of the sheet of paper P is passed therethrough at the step S402. The controller 50 determines which a surface of the sheet of paper P to be printed which the registration sensor 32 detects is the front thereof or the back thereof. For example, the controller 50 determines which the surface of the sheet of paper is the front thereof or the back thereof based on a detection result of a sensor set the sheet inverting portion 90. When the controller 50 determines that the surface of the sheet of paper P to be printed is the front thereof, the controller goes to a step S406. When the controller 50 determines that the surface of the sheet of paper P to be printed is the back thereof, the controller goes to a step S408.

When the controller 50 determines that the surface of the sheet of paper P to be printed is the front thereof, at the step S406, the controller 50 reads the shift information corresponding to the front of the sheet of paper P by referring to the table of the storage unit 42. This shift information is, for example, an amount of shift ΔS=1, maximum shiftable amount Sm=plus or minus 5 and shift cycle=10. When reading the shift information, the controller goes to steps S410 through S420.

On the other hand, when the controller 50 determines that the surface of the sheet of paper P to be printed is the back thereof, at the step S408, the controller 50 reads the shift information corresponding to the back of the sheet of paper P by referring to the table of the storage unit 42. The shift information is, for example, a program such as a formula for calculating an amount of shift ΔS on which the former reference position S' is shifted back to the default reference position S1. The controller 50 calculates the amount of shift ΔS on which the former reference position S' is shifted back to the default reference position S1 based on the above-mentioned formula. When calculating the amount of shift ΔS, the controller 50 goes to the step S420.

When the controller 50 determines that the surface of the sheet of paper P to be printed is the front thereof, at the step S420, the controller 50 calculates an amount of fluctuation ΔL of the registration and fluctuation unit 60 based on a detection result of the deviation detection sensor 30 and performs a shift correction to shift the sheet of paper P to the reference position set at the step S406. The controller 50 then performs the image forming processing on the sheet of paper P and then, transports the sheet of paper P to the sheet inverting portion 90. Since the sheet of paper P is shifted from the former reference position S' to the shifted reference position when the controller 50 determines that the surface of the sheet of paper P to be printed is the front thereof, it is possible to avoid passing the sheets of paper P through the same position of the fixing rollers 23, thereby preventing the fixing rollers 23 from being scratched.

On the other hand, when the controller 50 determines that the surface of the sheet of paper P to be printed is the back thereof, at the step S420, the controller 50 calculates an amount of fluctuation ΔL of the registration and fluctuation unit 60 based on a detection result of the deviation detection sensor 30 and performs a shift correction to shift the sheet of paper P back to the default reference position S1. The controller 50 then performs the image forming processing on the sheet of paper P and then, transports the sheet of paper P to the post-processing device 200. Since the sheet of paper P is shifted to the default reference position S1 when the controller 50 determines that the surface of the sheet of paper P to be printed is the back thereof, it is possible to transport the sheets of paper P, on the back of each of which an image is printed, to the stacker 210 of the post-processing device 200 without any deviation.

It is to be noted that as the shift operation when the controller 50 determines that the surface of the sheet of paper P to be printed is the front thereof, the shift controls described in the first through third embodiments may be applied thereto. For example, it is possible to control the amount of shift on which the sheet of paper P is shifted, on the basis of quality or transporting condition of the transported sheet of paper P such as the paper weight of the sheet of paper, the size of width of the sheet of paper and the transporting speed of the sheet of paper. This enables the sheets of paper to be aligned with high accuracy based on the quality or transporting condition of the transported sheets of paper P.

As described above, according the fourth embodiment, the controller 50 determines which the surface of the sheet of paper P is the front thereof or the back thereof. When the controller 50 determines that the surface of the sheet of paper P to be printed is the front thereof, the controller 50 shifts the reference position of the sheet of paper P and transports it to the sheet inverting portion 90. When the controller 50 determines that the surface of the sheet of paper P to be printed is the back thereof, the controller 50 shifts the sheet of paper P back to the default reference position S1 and transports it to the post-processing device 200. This enables input conditions to the stacker 210 of the post-processing device 200 to be fixed, thereby allowing the sheets of paper P to be aligned with high accuracy in the post-processing device 200.

The present invention is applicable to the image forming apparatus or the image forming system which is capable of correcting the positional deflection of the sheet of transporting paper with high accuracy.

Although the present invention has been described with reference to the embodiments above, it is to be noted that the present invention is not limited to the embodiments, and various changes and modifications are possible to those who are skilled in the art insofar as they are within the scope of the invention.

It should be understood by those skilled in the art that various modifications, combinations, sub-combinations and alterations may occur depending on design requirements and other factors insofar as they are within the scope of the appended claims or the equivalents thereof.

What is claimed is:

1. An image forming apparatus that forms an image on a sheet of paper, the apparatus comprising:

an information acquiring portion which acquires sheet information indicating quality or transporting condition of the transported sheet of paper;

a control portion that is configured to shift a reference position which has been previously set to a direction orthogonal to a transporting direction of the sheet of paper based on the sheet information acquired by the information acquiring portion;

a detection portion which detects a deviation of the sheet of paper with regard to the reference position shifted by the control portion along the direction that is orthogonal to the transporting direction of the sheet of paper; and a sheet shift portion which shifts the sheet of paper to the reference position shifted by the control portion based on the deviation detected by the detection portion, the sheet shift portion being positioned at an upstream side of an image forming position on which the image is formed on the sheet of paper;

wherein the information acquiring portion includes a paper-weight-acquiring part which acquires paper weight as the quality of the transported sheet of paper;

wherein the control portion is configured to shift the reference position to the direction orthogonal to the transporting direction of the sheet of paper based on the paper weight of the sheet of paper acquired by the paper-weight-acquiring part;

wherein the control portion is configured to stop a shift operation of the reference position when the paper weight of the sheet of paper acquired by the paper-weight-acquiring part is smaller than a previously set weight reference value; and wherein the control portion is configured to perform the shift operation of the reference position when the paper weight of the sheet of paper acquired by the paper-weight-acquiring part is not smaller than the previously set weight reference value.

2. The image forming apparatus according to claim 1, wherein:

the control portion is configured to change an amount of shift based on the paper weight of the sheet of paper when shifting the reference position to the direction that is orthogonal to the transporting direction of the sheet of paper.

3. The image forming apparatus according to claim 1, wherein:

the control portion is configured to change an amount of shift periodically when shifting the reference position to the direction that is orthogonal to the transporting direction of the sheet of paper.

4. The image forming apparatus according to claim 1, wherein:

the information acquiring portion includes a speed-acquiring part which acquires a transporting speed of the sheet of paper as the transporting condition of the transported sheet of paper;

when the transporting speed of the sheet of paper acquired by the speed-acquiring part does not exceed a previously set reference speed, the control portion is configured to perform a shift operation of the reference position by setting an amount of shift so as to be larger than the amount of shift set when the transporting speed of the sheet of paper acquired by the speed-acquiring part exceeds the previously set reference speed; and when the transporting speed of the sheet of paper acquired by the speed-acquiring part exceeds the previously set reference speed, the control portion is configured to perform the shift operation of the reference position by setting an amount of shift so as to be smaller than the amount of shift set when the transporting speed of the sheet of paper acquired by the speed-acquiring part does not exceed the previously set reference speed.

5. The image forming apparatus according to claim 1, further comprising:

a duplex printing portion which prints on both surfaces of the sheet of paper, wherein the control portion is configured to perform a shift operation of the reference position when printing on a front of the sheet of paper; and wherein the control portion is configured to shift the reference position to a previously set default reference position when printing on a back of the sheet of paper using the duplex printing portion.

6. The image forming apparatus according to claim 1, further comprising:

an image forming portion which forms the image on the sheet of paper, wherein the control portion is configured to control the image forming portion to shift an image forming position based upon the shifted reference position and to form the image on the sheet of paper.

7. The image forming apparatus according to claim 1, further comprising:

an image forming portion which forms the image on the sheet of paper; and a fixing portion which fixes the image transferred on the sheet of paper by the image forming portion, the fixing portion being provided at a downstream side of the image forming portion along the transporting direction of the sheet of paper.

8. An image forming system comprising:

(i) an image forming apparatus that forms an image on a sheet of paper, the apparatus including:

an information acquiring portion which acquires sheet information indicating quality or transporting condition of the transported sheet of paper;

a control portion that is configured to shift a reference position which has been previously set to a direction that is orthogonal to a transporting direction of the sheet of paper based on the sheet information acquired by the information acquiring portion;

a detection portion which detects a deviation of the sheet of paper in relation to the reference position shifted by the control portion along the direction that is orthogonal to the transporting direction of the sheet of paper; and a sheet shift portion which shifts the sheet of paper to the reference position shifted by the control portion based on the deviation detected by the detection portion, the sheet shift portion being positioned at an upstream side of an image forming position on which the image is formed on the sheet of paper;

wherein the information acquiring portion includes a paper-weight-acquiring part which acquires paper weight as the quality of the transported sheet of paper;

wherein the control portion is configured to shift the reference position to the direction orthogonal to the transporting direction of the sheet of paper based on the paper weight of the sheet of paper acquired by the paper-weight-acquiring part;

wherein the control portion is configured to stop a shift operation of the reference position when the paper weight of the sheet of paper acquired by the paper-weight-acquiring part is smaller than a previously set weight reference value; and wherein the control portion is configured to perform the shift operation of the reference position when the paper weight of the sheet of paper acquired by the paper-weight-acquiring part is not smaller than the previously set weight reference value; and (ii) a post-processing device including a paper alignment portion which aligns the sheet of paper ejected from the image forming apparatus.

9. The image forming system according to claim 8, wherein:

the control portion is configured to change an amount of shift based on the paper weight of the sheet of paper when shifting the reference position to the direction that is orthogonal to the transporting direction of the sheet of paper.

10. The image forming system according to claim 8, wherein:

the control portion is configured to change an amount of shift periodically when shifting the reference position to the direction that is orthogonal to the transporting direction of the sheet of paper.

11. The image forming system according to claim 8, wherein:

the information acquiring portion includes a speed-acquiring part which acquires a transporting speed of the sheet of paper as the transporting condition of the transported sheet of paper;

when the transporting speed of the sheet of paper acquired by the speed-acquiring part does not exceed a previously set reference speed, the control portion is configured to perform a shift operation of the reference position by setting an amount of shift so as to be larger than the amount of shift set when the transporting speed of the sheet of paper acquired by the speed-acquiring part exceeds the previously set reference speed; and when the transporting speed of the sheet of paper acquired by the speed-acquiring part exceeds the previously set reference speed, the control portion is configured to perform the shift operation of the reference position by setting an amount of shift so as to be smaller than the amount of shift set when the transporting speed of the sheet of paper acquired by the speed-acquiring part does not exceed the previously set reference speed.

12. The image forming system according to claim 8, wherein the image forming apparatus further comprises:

a duplex printing portion which prints on both surfaces of the sheet of paper, and wherein the control portion is configured to perform a shift operation of the reference position when printing on a front of the sheet of paper; and wherein the control portion is configured to shift the reference position to a previously set default reference position when printing on a back of the sheet of paper using the duplex printing portion.

13. The image forming system according to claim 8, wherein the image forming apparatus further comprises:

an image forming portion which forms the image on the sheet of paper, and wherein the control portion is configured to control the image forming portion to shift an image forming position based upon the shifted reference position and to form the image on the sheet of paper.

14. The image forming system according to claim 8, wherein the image forming apparatus further comprises:

an image forming portion which forms the image on the sheet of paper; and a fixing portion which fixes the image transferred on the sheet of paper by the image forming portion, the fixing portion being provided at a downstream side of the image forming portion along the transporting direction of the sheet of paper.

* * * * *